United States Patent [19]

Mock et al.

[11] Patent Number: 4,846,230

[45] Date of Patent: Jul. 11, 1989

[54] WOVEN RIBBON WITH WEFT THREADS JOINED IN PARALLEL BY WARP THREADS

[75] Inventors: Elmar Mock, Bienne; Clément Meyrat, Le Landeron, both of Switzerland

[73] Assignee: ETA SA Fabriques d'Ebauches, Granges, Switzerland

[21] Appl. No.: 132,226

[22] Filed: Dec. 14, 1987

[30] Foreign Application Priority Data

Dec. 15, 1986 [FR] France ..... 86 17626

[51] Int. Cl.[4] ..... D03D 13/00; D03D 15/00

[52] U.S. Cl. ..... 139/383 R; 139/420 R

[58] Field of Search ..... 139/383 R, 416, 420 R, 139/384 A, 384 R, 384 B

[56] References Cited

U.S. PATENT DOCUMENTS

| | | | |
|---|---|---|---|
| 2,581,261 | 1/1952 | Landau | 139/383 R |
| 3,322,163 | 5/1967 | Hughes | 139/383 R |
| 3,481,371 | 12/1969 | Row | 139/383 R |
| 4,499,842 | 2/1985 | Mahr | 139/420 R |
| 4,592,395 | 6/1986 | Borel | 139/416 |
| 4,660,605 | 4/1987 | Koch | 139/420 R |

FOREIGN PATENT DOCUMENTS

| | | |
|---|---|---|
| 126556 | 1/1902 | Fed. Rep. of Germany . |
| 1512865 | 1/1968 | France . |

*Primary Examiner*—Andrew M. Falik

*Attorney, Agent, or Firm*—Griffin, Branigan, & Butler

[57] ABSTRACT

A ribbon comprises weft threads (11) and warp threads (13) arranged respectively along the width and the length thereof and presenting in a narrow part (10) of its width at least one zone designed to be secured to a buckle, in which the weave is less close-woven than elsewhere to permit virtually continuous adjustment along its length. The weft threads are threads which are at least partially made from synthetic material and which are appreciably stiffer than the warp threads. The weft threads are joined in pairs of adjacent threads by the warp threads.

18 Claims, 3 Drawing Sheets

WOVEN RIBBON WITH WEFT THREADS JOINED IN PARALLEL BY WARP THREADS

TECHNICAL FIELD OF THE INVENTION

It is an object of the instant invention to provide a new woven ribbon, notably for a belt, thong, strap, handbag handle or watch wristlet, at least one extremity of which is designed to be secured at an adjustable distance to a buckle with a tang.

BACKGROUND TO THE INVENTION

At the present time when one makes an object or an article, such as those which have just been mentioned, using a woven ribbon, one does not content himself with making holes in this ribbon to permit passage of the tang.

Indeed, in order to enable the tang to be easily introduced into the holes at all times without risk of missing them, and to enable the fabric to stand up effectively to the pulling of the tang, it is necessary for the material to be composed of very stiff and very close-woven threads.

It is correct to say that it is always desirable or necessary for the object or article in question to be sufficiently stiff widthways, but not lengthways.

DESCRIPTION OF THE PRIOR ART

As a result, a fabric is chosen which makes it possible to fulfil this dual requirement of rigidity in width and pliancy in length, subsequently adopting one of the two following possibilities:

The first is to actually pierce holes in the woven ribbon and to surround these with eyelets.

The second is to fix to the end of the ribbon a band in a more resistant material then said ribbon, for example in natural or synthetic leather, and to pierce holes therein.

These two solutions have two disadvantages in common: they notably increase the cost of the object or the article and they do not permit a fine adjustment of the length thereof due to the relatively long gaps which must, nevertheless, be provided between the holes.

In addition, the first solution has another disadvantage. Namely, by interrupting the continuity of the position of the warp and weft threads, the holes weaken the mechanical resistance of the ribbon.

It has previously been proposed in French patent No. 1 512 865 which was filed on Feb. 28, 1967 to produce a ribbon having weft threads arranged substantially equidistantly along the width and warp threads along the length thereof and to provide a straight longitudinal zone totally devoid of warp threads for the passage of a tang and this specifically in order to eliminate the disadvantages of the first solution mentioned above. However the prior proposal suffers from the disadvantage that it does not give any details regarding the nature of the threads and the special mode or modes of weaving which must be employed in order to make the ribbon in question meet all the stated requirements. This earlier ribbon may, according to the inventor thereof, have any structure, but it is quite clear that this is not true. If this were so, ribbons of this type or articles made using them would doubtless have been on the market for a long time.

BRIEF SUMMARY OF THE INVENTION

It is an object of the instant invention to provide a solution which makes it possible to develop and improve the underlying concept of French patent No. 1 512 865 to an effective realization thereof.

It is also an object of the instant invention to provide a ribbon which may be manufactured in very large numbers and at a very low cost price.

These objects are achieved according to the invention, by providing a ribbon which also comprises weft threads and warp threads disposed respectively along the width and along the length thereof, and which also presents in a narrow part of its width at least one zone adapted to be secured to the buckle with a tang in which the weaving is less closely woven than elsewhere, but without the warp threads necessarily being absent form this zone, the weft threads being threads which are at least partially composed of synthetic material and which are appreciable stiffer than the warp threads. Moreover, the ribbon is woven in such a way that the weft threads are joined in pairs of adjacent threads by the warp threads.

The weft threads thus confer to the ribbon the desired stiffness in width and the warp threads its pliancy in length.

Moreover, there are two advantages in joining the weft threads in pairs:

Firstly, these pairs are more resistant to the pulling of the tang than if they were regularly distributed along the direction of the length of the ribbon, as is the case in the above mentioned French patent.

Secondly, in this manner one creates small spaces between the pairs into which the tang can easily penetrate, while continuing to provide the possibility of virtually continuous adjustment along the length of the ribbon.

As regards the weft threads, it is often preferable to use solid threads entirely of synthetic material, but one can also in certain cases resort to composite threads composed of a core of natural fiber and a sheath of synthetic material.

As regards the warp threads the choice is very great. One may for example use threads composed of very fine clusters of fibers and/or slightly twisted, natural or artificial fibers.

In addition, to obtain a less close-woven weave in the narrow part one can for example arrange that the warp threads in that portion are less close to one another than in the other parts or that the weft threads pass in this area from the same side as the warp threads.

If one opts for the solution which consists in not providing warp threads in the narrow part one can weave on both sides thereof a warp thread that is solid, thin and stiff or a pair of adjacent threads of this type which pass alternately from one side to the other of consecutive pairs of weft threads. In so doing, one accentuates the stiffness of the weft threads in the central region of the ribbon and one prevents the other warp threads, which are much more pliant, from spreading into the narrow part.

Finally, it is obvious that one can very greatly vary the appearance of the ribbon by using threads of different colours and different modes of weaving.

Other features and advantages of the ribbon according to the invention will appear from a study of the following description of four possible embodiments which are chosen simply for purposes of example and which are particularly well adapted for use in a watch wristlet.

DETAILED DESCRIPTION OF THE INVENTION

Figure 1:
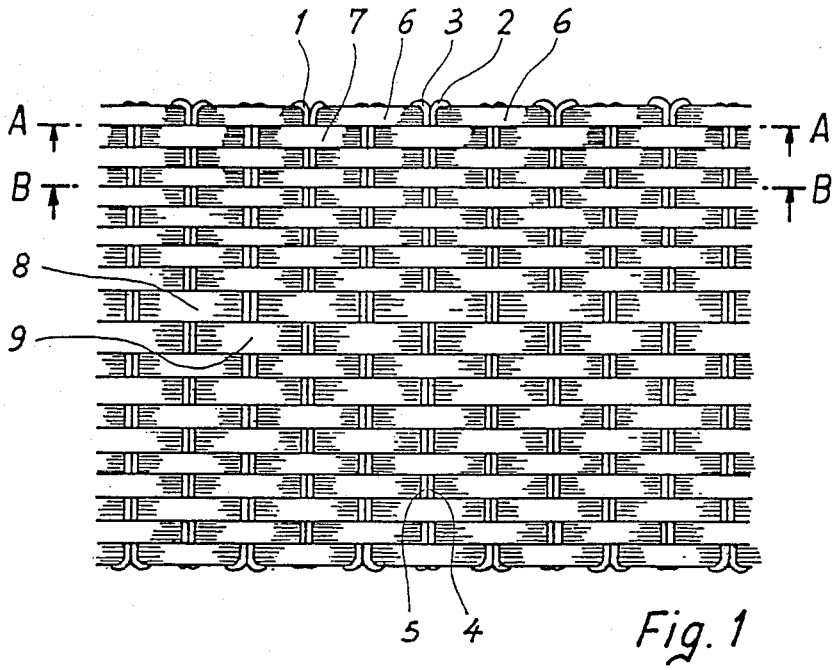
FIG. 1 is a plan view of a first embodiment of the invention.

The weft of the ribbon shown in FIG. 1 is composed of a single thread 1 which is continuous, thin, solid and of a resilient synthetic material. The thread 1 is folded back on itself succesively on each of the edges of the ribbon in turn as is apparent in particular at 2 and 3, on the edge of the underside of the ribbon. In so doing it forms pairs of adjacent weft threads 4, 5, all regularly spaced as is evident from FIG. 1A. Every other pair is visible.

Figure 1A:
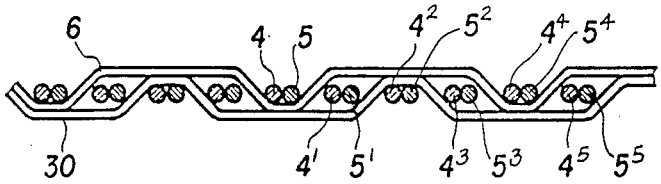
FIG. 1A is a sectional view taken along line A—A of FIG. 1.
Figure 1B:
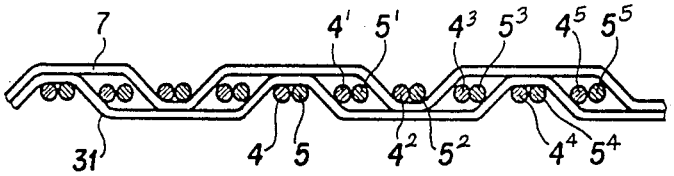
FIG. 1B is a sectional view taken along line B—B of FIG. 1.

The warp of the ribbon is formed of two superimposed layers of threads, each formed of very fine fibers that are in clusters and/or slightly twisted. Only those in the upper layer such as threads 6 and 7 are visible in FIG. 1. As shown in FIGS. 1A and 1B the warp thread 6 of the upper layer passes alternately above three consecutive pairs of adjacent weft threads, such as $4^1$, $5^1$, $4^2$, $5^2$, and $4^3$ $5^3$ then under the next pair of weft threads. Alternate threads of this upper layer pass over and under the same pairs of adjacent weft threads as the thread 6. As shown in FIG. 1B, the thread 7 passes alternately under the pair of adjacent weft threads $4^2$, $5^2$ which is located in the middle of those over which the thread 6 passes, then over the three following consecutive pairs of adjacent weft threads $4^3$, $5^3$, $4^4$, and $5^4$ and $4^5$, $5^5$ As shown in FIGS. 1A and 1B warp threads 30 and 31 of the lower layer each passes alternately over the pair of adjacent weft threads located in the middle of those over which there passes a warp thread of the upper layer, then under the three following pairs of adjacent weft threads. Thus, in FIG. 1A warp thread 30 passes over the pair of weft threads $4^2$, $5^2$ and then under the pairs of weft threads $4^3$, $5^3$, $4^4$, $5^4$, and $4^5$, $5^5$ while in FIG. 1B warp thread 31 passes over the pair of weft threads 4, 5 and then under the pairs of weft threads $4^1$, $5^1$, $4^2$, $5^2$ and $4^3$, $5^3$. The parts of the warp threads of the lower layer which pass over a pair of adjacent weft threads are covered by the warp threads of the upper layer which pass over this same pair of weft threads, as well as over the two neighbouring pairs. Similarly, the warp threads of the lower layer which pass under three successive pairs of adjacent weft threads hide the parts of the warp threads of the upper layer which pass under a single pair of the adjacent weft threads.

The warp threads are closely packed together except for the two threads 8 and 9 which are located in the middle of the width of the ribbon. As shown in FIG. 1 the space which they occupy is almost as wide as that occupied by three other adjacent warp threads.

A tang 32 (FIG. 5) to which one of the ends of the described ribbon is designed to be secured and which is located in the middle of the width of the ribbon may thus create a path between the two warp threads 8, 9 and between the two consecutive pairs of adjacent weft threads without damaging either the one or the other of these groups of threads. Since the pairs of consecutive weft threads are relatively close to one another, the described ribbon facilitates fine adjustment of its active length.

Figure 2:
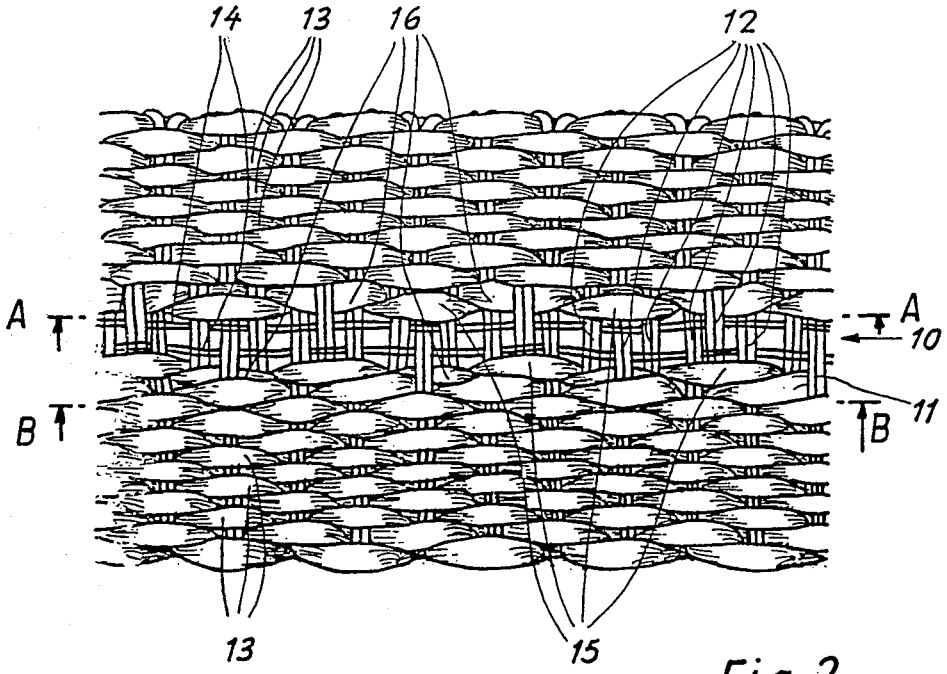
FIG. 2 is a plan view of a second embodiment of the invention.
Figure 2A:
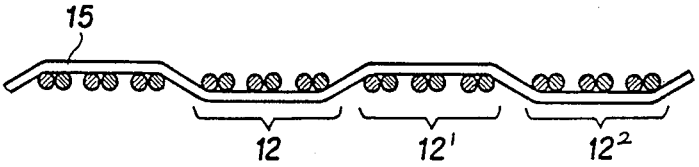
FIG. 2A is a sectional view taken along line A—A of FIG. 2.

The ribbon of FIG. 2 is mainly distinguished from that of FIG. 1 by the fact that it presents, in the middle of its width, a narrow part 10 which is solely occupied by weft threads 11. The tang 32 (FIG. 5) to which one extremity of the ribbon is designed to be secured, naturally engages itself in the free spaces between threads 11. Although threads 11 are made up of segments, folded back in zig zag form all along the ribbon, of a single and same thread, identical to that of FIG. 1 they are grouped here in triplets 12 of consecutive pairs of adjacent threads as shown in FIG. 2A. Pairs of a triplet 12 are closer to each other than are the triplets amongst themselves. This is shown in FIG. 2A where the pairs of a triplet 12 are closer together than the distance between the right-most pair of triplet 12 the left-most pair of the next triplet $12^1$.

The nature and the weave of the warp threads 13 are identical to those of FIG. 1. Nevertheless, two means are provided to prevent the warp threads 13 from spreading into the part 10 of the ribbon and to confer to the weft threads of this part 10 a stiffness enabling them to suitably resist the pulling forces exerted thereon by the tang, to which one extremity of the ribbon is designed to be secured.

The first of these means consists of a pair of adjacent warp threads 14 that are solid, thin and stiff, of synthetic material, and which extend the length of each of the edges of part 10. Each thread 14 passes alternately from one to the other side of the consecutive pairs of adjacent weft threads.

Figure 2B:
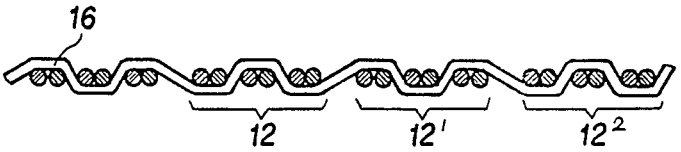
FIG. 2B is a sectional view taken along line B—B of FIG. 2.

The second means consists of the special weaving of the two warp threads 15, 16 alongside threads 14, on each side of the part 10. The thread 15 (FIG. 2A) passes successively from one to the other side of the consecutive triplets 12, $12^1$. The thread 16 (FIG. 2B) passes in turn from one to the other side of each consecutive pair of adjacent weft threads. The threads 15, 16 are of the same nature as the threads 13.

Figure 3A:
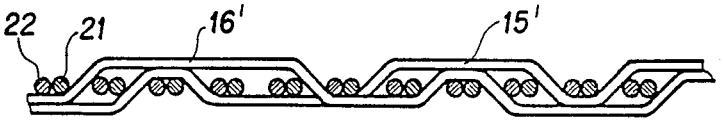
FIG. 3A is a sectional view taken along line A—A of FIG. 3.
Figure 3:
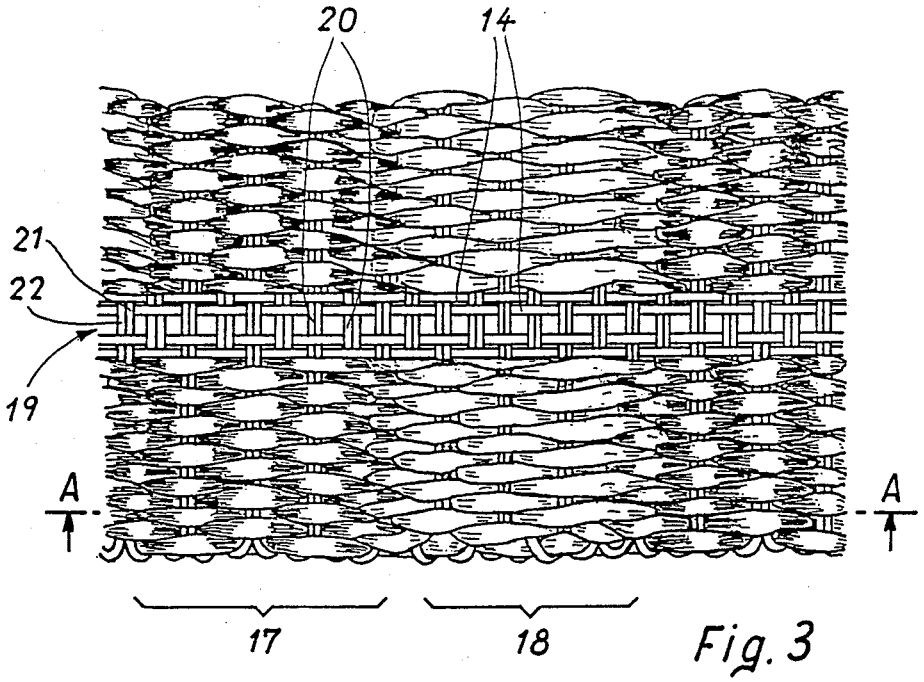
FIG. 3 is a plan view of a third embodiment of the invention.

The embodiment shown in FIG. 3 is mainly distinguished from that of FIG. 2 by the fact that the two layers of warp threads $15^1$, $16^1$ of different colors, pass simultaneously and from place to place from one side to the other of the weft as shown in FIG. 3A. The ribbon therefore presents segments 17, 18 of alternating colors.

In this case, and as is shown in FIG. 3, the two adjacent solid, thin and stiff warp threads 14 which extend along one edge and the other edge of the narrow median part 19 of the ribbon, pass the one from the one side and the other from the other side of successive pairs 20 of adjacent weft threads 21, 22 which, in this embodiment, are regularly spaced amongst each other.

Figure 4:
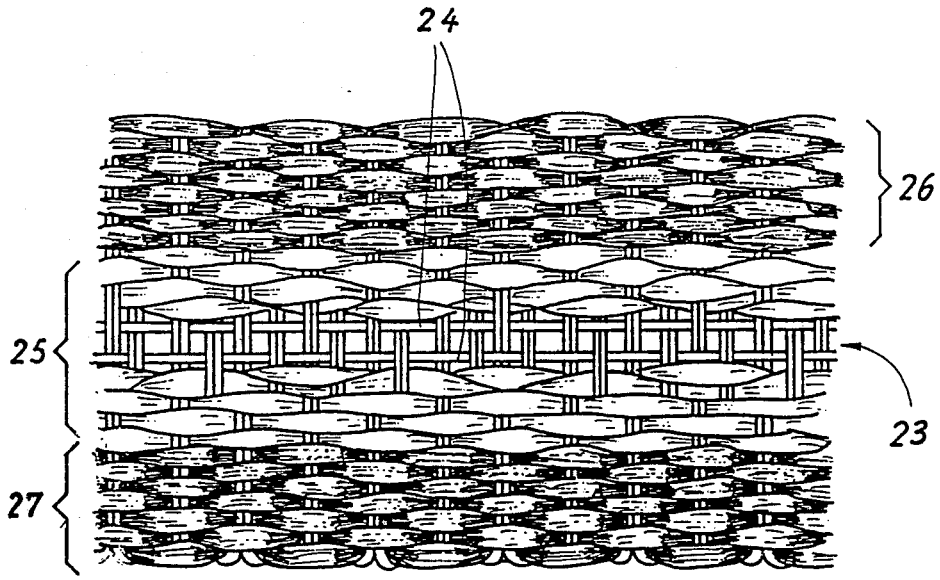
FIG. 4 is a plan view of a fourth embodiment of the invention.

In the embodiment shown in FIG. 4 the weaving is identical to that in FIG. 2. On both sides of the narrow central part 23 of the ribbon there is, however, only one single, solid, thin and stiff warp thread 24 which passes successively from one side to the other of the consecutive pairs of adjacent weft threads. Moreover, some warp threads from the central zone 25 of the ribbon have visibly the same color as the weft threads, so as to camouflage these latter which occupy the narrow part 23, whereas the outer warp threads, zones 26 and 27, have a different color.

The ribbon of this last embodiment illustrates another very simple way of varying the appearance.

In the four embodiments shown in the drawing, the central part of the ribbon which is less close-woven naturally extends the full length of the ribbon. It is, nevertheless, possible to limit this special weave to that zone of the ribbon which is specifically designed to be secured to the tang in question. For this purpose it is sufficient to pass the weft threads of this zone on the same side of the two, three or four warp threads located in the middle of the width of the ribbon or between the same warp threads of the two superimposed layers. The tang could then pass through this zone of the ribbon, engaging between the weft threads and the free warp threads in the weft without risk of damaging either the one or the other of these threads.

Figure 5:
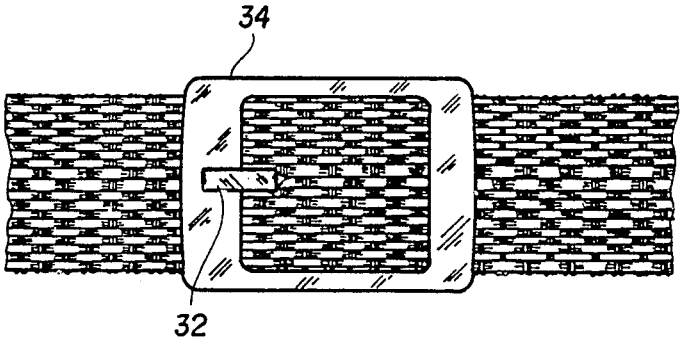
FIG. 5 illustrates a portion of a wristlet utilizing the invention.

Generally, the fixing of a buckle 34 having a tang 32, as illustrated in FIG. 5, to one extremity of the ribbon according to the invention presents no difficulty. It suffices to engage this extremity of the ribbon in the buckle or a part thereof, to fold it over the rest of the ribbon and to fix it to the latter, for example by means of one or several rivets. It can also be fixed thereto by fusing, sewing or glueing. If all the threads of the ribbon and the buckle are of a synthetic material, the extremity of the ribbon may even be fused directly onto the buckle.

Moreover, when the invention is used for example in the manufacture of watch wristlets it is not essential to limit the weave to each strand of the individual strap. One can also weave a long band, the width of which is a multiple of that of the strands of the wristlet to be manufactured providing at various places across this band narrow parts where the weave is less close-woven than elsewhere, as described above, the spacing of which corresponds to the width of the wristlets, and then to cut these latter into the said band of the desired length.

If the weft thread is of an entirely synthetic material, the widthwise cutting of the strands of the wristlets may advantageously be effected under heat, for example, ultrasonically. This procedure would at the same time effect the fusing together of the extremities of the weft threads along the edges of the wristlet.

If, on the other hand, these threads are mixed, that is if they are composed of a natural fiber core, for example cotton, sheathed in synthetic material, for example PVC, the cutting could be effected by high frequency, which would at the same time ensure the fusing together of the ends of these threads.

The fixing of the strands of the wristlet to the lugs of the watch casing can be effected in analagous manner to those described above, to a buckle. The strand of the wristlet extending from the watch casing to the buckle with tang does not of course need to present a straight central part that is less close-woven except in order to preserve the continuity in the appearance of the wristlet.

What has been said above with regard to the manufacture per se of watch wristlets can naturally apply to the production of other articles.

Moreover, it is quite clear that the invention also applies to ribbons designed to be associated with buckles having several tangs.

What is claimed is:

1. A woven ribbon, especially for a belt, thong, strap, handbag handle or watch wristlet, one extremity of which is designed to be secured at an adjustable distance from a buckle with a tang, said ribbon comprising weft threads and warp threads disposed along the width and length thereof respectively, and presenting in a narrow part of its width at least one zone adapted to be secured to a buckle in which the weave is less close-woven than elsewhere, said weft threads being threads which are at least partially composed of synthetic material and appreciably stiffer than the warp threads and said ribbon being woven in such a way that the weft threads are joined in pairs of adjacent weft threads by the warp threads with each weft thread being in only one pair.

2. A ribbon according to claim 1, wherein the weft threads are solid threads, entirely of synthetic material.

3. A ribbon according to claim 2 wherein warp threads are composed of very fine fiber clusters.

4. A ribbon according to claim 2 wherein the warp threads are slightly twisted.

5. A ribbon according to claim 1 wherein the warp threads are composed of very fine fiber clusters.

6. A ribbon according to claim 1 wherein said narrow part of the ribbon is only composed of weft threads.

7. A ribbon according to claim 6 whereby only a few warp threads, situated on both sides of said narrow part of the ribbon have the same color as the weft threads.

8. A ribbon according to claim 1 wherein on both sides of said narrow part of the ribbon there is woven at least one warp thread which is solid, thin, and stiff and passes alternately from one side to the other of consecutive pairs of weft threads.

9. A ribbon according to claim 8 wherein only a few warp threads, situated on both sides of said narrow part of theribbon have the same color as the weft threads.

10. A ribbon according to claim 8 having two faces, wherein the weft threads form triplets of close pairs of adjacent threads, the space between the triplets being larger than that between the pairs of adjacent threads of a triplet and where the warp threads are woven in two superimposed layers, each partly visible on one of the faces of the ribbon, the parts of the warp threads of one of these layers which are visible on one face of the ribbon, pass from the same side of three successive pairs of adjacent weft threads and cover the parts of the warp threads of the other layer which pass from this same side as that of the pairs of weft threads which are located between the two others, both two warp threads of one or other of these two layers passing from the same side of three same pairs of weft threads, the single or the two parts of the warp threads next to that of the same layer, which pass from the same side of three consecutive pairs of weft threads passing from the other side of the median pair of weft threads.

11. A ribbon according to claim 10 wherein the two warp threads next to the solid and thin warp threads pass alternately, the one from one side to the other side of each consecutive pair of weft threads, and the other from one to the other side of each consecutive triplet of weft threads.

12. A ribbon according to claim 8 wherein the weft threads form triplets of close pairs of adjacent threads and the two warp threads next to the solid and thin warp threads pass alternately, one from one to the other side of each consecutive pair of weft threads, and the othe from one to the other side of each consecutive triplet of weft threads.

13. A ribbon accordindg to claim 12 wherein the two layers of warp threads have different colors the warp threads of one layer passing from place to place, from one side to the other of the weft.

14. A ribbon according to claim 13 wherein the two layers of warp threads have different colors the warp threads of one layer passing from place to place, from one side to the other of the weft.

15. A ribbon according to claim 10 wherein the two layers of warp threads have different colors, the warp threads of one layer passing from place to place, from one side to the other of the weft.

16. A ribbon according to claim 1 wherein, in the zone of the ribbon to be secured to a buckle with a tang, the weft threads pass from the same side of the warp threads situated in said narrow part of the ribbon in the middle of its width.

17. A ribbon according to claim 1 wherein the warp threads are slightly twisted.

18. A ribbon accroding to any of claims 1, 2, 5, 12, 13 or 14 wherein in said narrow part of the ribbon the warp threads are less close to one another than in the other parts of the ribbon.

* * * * *